US007954349B2

(12) United States Patent
Knewtson

(10) Patent No.: US 7,954,349 B2
(45) Date of Patent: Jun. 7, 2011

(54) METHOD AND APPARATUS FOR CREATING STACKS OF NESTED SINUOUS SPRINGS

(75) Inventor: Kelly M. Knewtson, Joplin, MO (US)

(73) Assignee: L&P Property Management Company, South Gate, CA (US)

( * ) Notice: Subject to any disclaimer, the term of this patent is extended or adjusted under 35 U.S.C. 154(b) by 825 days.

(21) Appl. No.: 11/969,486

(22) Filed: Jan. 4, 2008

(65) Prior Publication Data

US 2009/0173125 A1 Jul. 9, 2009

(51) Int. Cl.
*B21B 39/02* (2006.01)
*B21F 45/00* (2006.01)
*B21F 35/00* (2006.01)

(52) U.S. Cl. ..... 72/133; 140/71 R; 29/896.9

(58) Field of Classification Search ..... 72/129, 72/133, 381, 426, 169, 385; 140/71 R, 92.1, 140/92.2, 103, 105; 414/788.1; 242/528, 242/535, 360, 361.1, 361.2, 361.3, 362, 362.1, 242/362.2, 362.3; 29/33 F, 896.9
See application file for complete search history.

(56) References Cited

U.S. PATENT DOCUMENTS

| | | | |
|---|---|---|---|
| 2,540,972 | A | 2/1951 | Wagner, Jr. et al. |
| 2,800,928 | A | 7/1957 | Norman |
| 3,040,798 | A | 6/1962 | Johnson |
| 4,121,628 | A | 10/1978 | Waligore et al. |
| 4,270,582 | A | 6/1981 | Norman |
| 4,890,975 | A | 1/1990 | Hoff et al. |
| 4,964,781 | A | 10/1990 | Jenkner |
| 5,150,600 | A | 9/1992 | Wentzek et al. |
| 5,187,919 | A | 2/1993 | Guardiola |
| 7,128,519 | B2 | 10/2006 | Yin |

*Primary Examiner* — Teresa M Ekiert
(74) *Attorney, Agent, or Firm* — Wood, Herron & Evans, LLP

(57) ABSTRACT

A method and apparatus is disclosed for simultaneously creating a pair of stacks of nested sinuous spring strips. This apparatus includes first and second generally circular forming drums onto which a feeder mechanism is operable to sequentially and alternately pass each of the spring strips from over a forming mandrel onto the top surface of the first and second generally circular forming drums. A first stripper mechanism is then operable to strip a first one of the strips onto a first stacking drum and for stripping a second following one of the strips onto a second stacking drum. A second stripper mechanism is then operable to strip those stacks from the stacking drums onto a pair of discharge chutes.

16 Claims, 10 Drawing Sheets

METHOD AND APPARATUS FOR CREATING STACKS OF NESTED SINUOUS SPRINGS

FIELD OF THE INVENTION

This invention relates generally to arcuate sinuous wire springs and, more particularly, to a method and apparatus for arranging a plurality of arcuate sinuous wire springs in a generally circular nested stack.

BACKGROUND OF THE INVENTION

Many furniture products, including such products as chairs, sofas and automobile seats utilize sinuous wire spring elements as to create resilient surfaces, such as seats and backrests, in an item of furniture. Such resilient spring elements are disclosed, for example, in U.S. Pat. No. 2,800,928. Generally, these spring elements are of an arcuate or curvilinear shape which creates a problem in storing and using those elements, particularly if those elements are manufactured in one facility and utilized in another manufacturing facility. It has therefore become common practice to create a nested bundle of those elements for storage or shipment from one location to another.

U.S. Pat. No. 4,270,582 discloses a machine for creating a nested bundle of such arcuate configurated sinuous springs. According to the disclosure of this patent, precut straight spring elements are fed into the machine which imparts an arcuate curvilinear shape to the spring elements. The curvilinear or arcuate spring elements are engaged by the teeth of a gear or protrusions on the surface of a feed wheel to feed or load those curvilinear or arcuate-shaped sinuous spring elements into a first or primary cage or drum which effectively compresses the arcuate spring element into a generally circular configuration within the interior of the primary cage or drum. After the completion of the loading of the arcuate spring into the interior of the primary cage or drum, a stripper is actuated to impart an axial force upon the compressed circular-shaped arcuate spring, causing it to pass into a secondary cage or drum of larger diameter where the arcuate spring expands into contact with the interior surface of the secondary cage or into contact with the interior surface of a previously loaded arcuate spring contained within the secondary cage. After a predetermined number of springs have been loaded into the secondary cage or drum, the secondary drum is rotated to an unloading position whereat a stack of nested arcuate spring elements are removed from the secondary cage.

U.S. Pat. No. 5,150,600 also discloses a machine for automatically creating nested stacks of arcuately configured sinuous springs similar to the disclosure of U.S. Pat. No. 4,270,582. This patent also inserts the arcuately configured springs into the interior of a primary or first cage or drum so as to create a generally circular configured arcuate spring and then passes that generally circular arcuate spring from the interior of the first primary drum into the interior of a larger diameter circular cage or drum whereat the generally circular configured arcuate spring expands into contact with the interior surface of the secondary cage or drum or into contact with a previously inserted circular configured arcuate spring. According to the disclosure of this patent, a stripper is actuated after a predetermined number of sinuous springs have been nested within the interior of the secondary cage or drum so as to deposit the stack of nested springs onto a discharge chute.

Machines made in accordance with the disclosure of the above-identified patents are subject to the criticism that they are generally very noisy because of the clash of the input feed wheels with the transverse parallel bars of the sinuous springs. They are also subject to the criticism that they are very limited in the configuration of the springs which they are able to handle without a substantial reset-up and reconfiguration of the machines, often times requiring many hours or even days of reset-up operator time. The nature of sinuous springs, though, as used in the furniture industry, is that there are hundreds or even thousands of different furniture products which utilize such springs of varying and differing length, resilient characteristics, temper of the spring wire, differing gauge wire and spacing of the parallel bars of the spring. All of these differing characteristics of the sinuous springs dictate that a machine for nesting such springs should be capable of handling and stacking sinuous springs of varying dimensions and characteristics. It has therefore been an objective of this invention to overcome these limitations relative to the versatility of the machine to handle arcuate springs of different lengths and configurations with minimal requirements for reset-up operator time.

Another objective of the invention of this invention has been to increase the speeds of the machine and maintaining continuity of springs in a stack of nested springs created by the machine. The nature of sinuous springs is that if the sinuous springs being stacked by the machine have an uneven number of bars in the individual spring element, every other spring in the stack will have an end section which is curved in a direction opposite to the end of the spring which preceded it. It has therefore been an objective of this invention to create stacks of nested coil springs of either even or uneven number of parallel bars in which all of the end turns of the stack of springs in a nest are oriented in the same direction. At the present time, there are no machines, including the machines described in the above-identified patents, capable of nesting and stacking sinuous wire springs having uneven numbers of parallel bars with the end turns of the springs oriented in the same or a common direction as required by furniture manufacturers. Such uneven number of bar sinuous springs, which are commonly used in the furniture industry, are now manually removed from the machine which imparts an arcuate configuration to the spring and manually stacked in a nested arrangement.

SUMMARY OF THE INVENTION

The apparatus or machine of this invention which accomplishes these objectives and one aspect of the invention of this application comprises a feeder mechanism for sequentially feeding sinuous spring strips of a discrete length over a forming mandrel to impart an arcuate configuration to each strip and then feed the arcuate strip onto the surface of a generally circular forming drum. A stripper mechanism then is operable to strip a first one of the arcuate configured strips from over the forming drum and onto the top surface of a smaller diameter stacking drum and then sequentially strip a following plurality of arcuate configured strips from the forming drum onto the stacking drum and over the top of the strip which preceded it onto the stacking drum to create a nested plurality of arcuate configured springs located on the stacking drum. By creating the nest of arcuately configured springs one atop the other, rather than by forcing one to the inside of the strip which preceded it into the nest, as in the prior art machines, the machine of this invention is capable of handling a much greater variety of springs with less criticality of dimensional similarity from one spring to the next. According to the disclosure of this invention, the feeder mechanism is preferably in the form of an endless feeder belt rather than a spoked or gear-type feeder wheel with the result that the machine operates much more quietly and again, with much less criticality of dimensional similarity from one spring to the next.

In the practice of another aspect of this invention, the feeder mechanism is operable after imparting an arcuate configuration to each strip as it passes over the forming mandrel to sequentially and alternately move the arcuate configured strips over first and second generally circular forming drums. A first stripper mechanism is then operable to strip a first one of the arcuate configured strips from over a first one of the forming drums and onto a top surface of a first stacking drum of less diameter than the forming drum and then strip a second following one of the arcuate configured strips from over the second forming drum onto a top surface of a second stacking drum, which first stripper mechanism is then operable to sequentially and alternately strip following arcuate configured strips from the first and second forming drums onto the first and second stacking drums, respectively, and over the top surface of the preceding strips on the stacking drums to create a pair of nested plurality of arcuate configured strings located on the first and second stacking drums. After a predetermined number of arcuate configured springs are contained in each nest on each stacking drum, a second stripper mechanism is operable to strip those nested sinuous springs from the stacking drums onto a pair of first and second discharge chutes. This use of two forming drums and two stacking drums not only speeds up the machines and the rate at which they may accept and form the curvilinear-shaped sinuous springs into nested stacks of such springs, but also enables each stack to contain identical springs having the same orientation of end sections of the spring even though the springs may have an uneven number of parallel bars over the length of the spring.

These and other objects and advantages of this invention will become more readily apparent from the following description of the drawings.

DETAILED DESCRIPTION OF THE INVENTION

Figure 1:
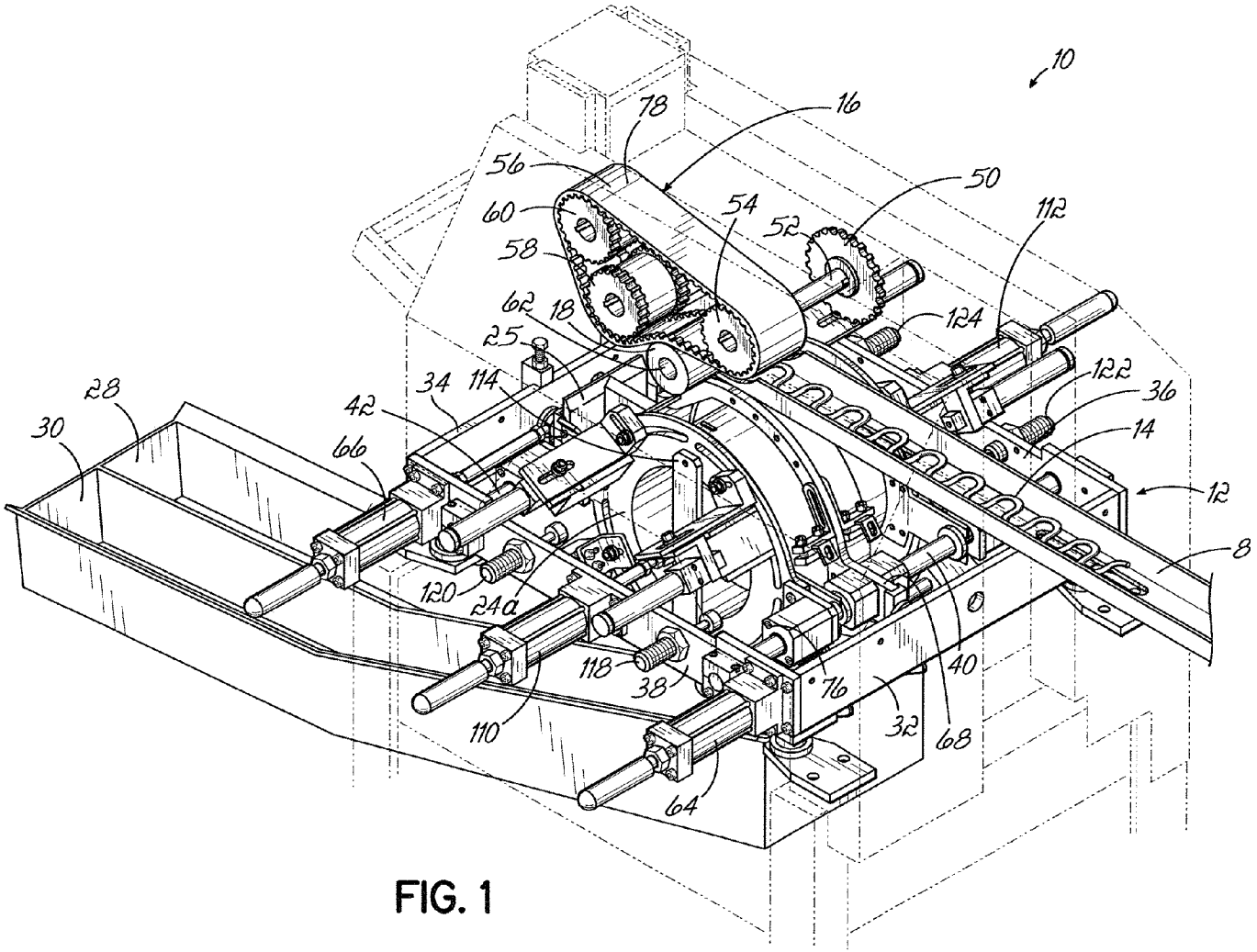
FIG. 1 is a partially diagrammatic perspective view of a machine for practicing the inventive method and machine of this invention with portions of the machine supporting frame and enclosure housing shown in phantom.

The sinuous spring nesting and stacking machine 10 of this invention comprises a rectangular frame 12 upon which is mounted a sinuous spring infeed mechanism 16 for causing straight discrete lengths 14 of sinuous wire to be fed into and over a rotating mandrel 18 which imparts an arcuate curvilinear shape to those lengths 14 of sinuous wire springs. Those discrete straight lengths 14 of sinuous wire are derived from a conventional continuously operating wire forming machine 2 (see FIG. 9) which continuously feeds sinuous wire into a standard loop accumulator 4 from which the wire is fed into a cut-off machine 6. From the cut-off machine 6, the lengths 14 of straight sinuous wire are supplied to the feeder mechanism 16 of the nesting and stacking machine, which is synchronized by a conventional common controller (not shown) with the forming machine 2, accumulator 4 and cut-off machine 6.

The arcuately formed curvilinear sinuous springs 15 are then caused by the infeed mechanism 16 to be moved alternately over one of two circular forming drums 20, 22. Those forming drums, as explained more fully hereinafter, are caused to reciprocate between two positions such that after a first spring 15 is deposited upon one forming drum 20, the forming drums are shifted to align the second forming drum with the infeed mechanism preparatory to the next following spring 15 being deposited on the second forming drum 22. Located internally of these forming drums 20, 22 are a pair of smaller diameter stacking drums 24, 26 (see FIGS. 4 and 6A). As the forming drums 20, 22 reciprocate after having a spring 15 deposited thereon, the next following reciprocable stroke of the forming drums causes the springs 15 to be moved off of the forming drum 20, 22 and onto the underlying stacking drum 24 or 26, respectively. Consequently, the sequence is for a first arcuately formed spring 15 to be deposited upon a first forming drum 22, for example. The drums are then reciprocated rightwardly so as to align the forming drum 20 with the infeed mechanism 18 and position the spring 15 on the drum 22 over the stacking drum 26. The next leftward movement of the forming drums 20, 22, after a spring 15 is deposited on the forming drum 20, causes the spring 15 on the forming drum 22 to be moved off of the first forming drum 22 and onto the underlying stacking drum 26. The next following rightwardly movement of the forming drums 20, 22, the spring 15 causes the spring 15 on the leftward forming drum 20 to be stripped from that forming drum 20 and onto the underlying stacking drum 24. This procedure is followed until a predetermined number of arcuate curvilinear springs 15 have been alternately and sequentially deposited upon each of the stacking drums 24, 26, after which the stacking drum 26 is moved rightwardly, so as to strip the nested stack of springs on that stacking drum 26 from the stacking drum 26 and allow that stack to fall onto an underlying discharge chute 28 or 30. The stacking drum 24 is then moved leftwardly and the stack of springs or the stacking drums stripped from that stacking drum 24. Thereafter, the stacking drums 24, 26 are moved back to their original positions beneath their respective forming drums 20 or 22 preparatory to receiving the next following spring 15 from that forming drum. This sequence of operations is all controlled by a common controller (not shown) which synchronizes the drive of the complete machine 10, including its infeed mechanism 16 with the drive of the sinuous wire forming machine 2, accumulator 4 and cut-off machine 6.

Nesting Stacking Machine Frame

The nesting stacking machine frame 12 is generally rectangular and comprises a front plate 32, a rear plate 34, and side plates 36, 38. This frame is illustrated as being bolted together, but could as well be welded or connected via any other conventional connectors. The machine frame 12 is, in turn, mounted upon a base frame and enclosed within a housing 12*a* (shown in phantom in FIG. 1) as is conventional with all machinery having moving parts.

Fixedly mounted upon this frame 12 and extending between the side plates 36, 38, there are a pair of supporting shafts 40, 42. These shafts 40, 42 extend through apertures (not shown) in the side plates and are secured to the side plates by mounting blocks 44. The mounting blocks 44 each comprise pairs of blocks 44*a*, 44*b* located on the outside of each end of the shafts 40, 42 and secured together by conventional screws so as to clamp the ends of the shafts 40, 42 therebetween. The lowermost one of each pair of blocks 44*a*, 44*b* is then secured to the outside surface of the side rails 36, 38 by set screws 44*c*. As explained more fully hereinafter, these supporting shafts 40, 42 then serve as mounting shafts for the reciprocable forming drums 20,22 and the mechanism movable with those drums 20,22. These shafts 40, 42 also support the independently movably stacking drums 24, 26 as well as stationary stacking drum stripper paddles 46,48 (see FIGS. 7A and 7B) associated with the stacking drums 24, 26.

Sinuous Spring Infeed Mechanism

The belt drive infeed mechanism 16 is driven from a timing input gear 50 operable through a shaft 52 to drive a drive gear or pulley 54 and, through an endless flexible belt 56, pair of idler gears or pulleys 58, 60. The flexible endless belt 56 is movable over these gears or pulleys 54, 58, 60 and has an outside peripheral surface 78 engageable with the top surface of incoming straight lengths 14 of sinuous wire so as to move those lengths 14 of sinuous wire into surface contact with the rotating mandrel 18. The mandrel 18 is rotatably mounted upon a shaft 62 which is, in turn, fixedly secured to the frame 12. The complete infeed mechanism 16 is mounted upon a separate frame (not shown) which is, in turn, fixedly secured to the machine frame 12. The infeed mechanism is so constructed that the intermediate gear or pulley 58 is adjustably mounted so as to enable it to be moved relative to the mandrel 18 and thereby vary the configuration of the arc imparted to the sinuous spring 15 by the mandrel 18 as the wire moves over the mandrel.

Spring Stripper Mechanism

The mechanism for affecting reciprocable movement of the forming drums 20, 22 comprises a pair of air cylinders 64, 66 bolted to the outside surface of the side plate 38. The piston rods 64*a*, 66*a* of these cylinders extend through the side plate 38 and are fixedly connected through an appropriate linkage 70, 72 to a slider plate 68 to which the forming drums 20, 22 are fixedly attached. This slider plate 68 is sandwiched between the forming drums 20, 22 and is connected via the linkages 70, 72 to the piston rods 64*a*, 66*a* such that upon simultaneous actuation of the cylinders 64, 66, the slider plate is caused to slide and reciprocate over the supporting shafts 40, 42 between the two positions illustrated in FIGS. 4 and 5. As may be seen most clearly in FIGS. 4 and 5, the slider plate 68 has a bore (not shown) axially aligned with bores 70 in mounting blocks 72, 74 located on opposite sides of the mounting plate and secured thereto by bolts 76. The support shafts 40, 42 extend through the axially aligned bores of the slider plate and the mounting blocks 72, 74, thereby enabling the slider plate 68 with its attached forming drums 20, 22 to slide over the support shafts 40, 42 upon simultaneous actuation of the cylinders 64, 68 secured to opposite ends of the slider plate 68 via the piston rods 64*a*, 68*a* and the linkages 70, 72.

Proximity Trigger Assembly

Adjustably mounted upon opposite sides of the slider plate 68, there are a pair of proximity trigger assemblies 106, 108. Each trigger assembly 106, 108 comprises a pair of parallel plates 106*a*, 106*b* and 108*a*, 108*b* separated by a spring assembly 106*c*. These proximity trigger assemblies function as stops as springs wrap around the forming drums 20,22 to limit the rotary movement of the spring about the forming drum and stop it when the leading end of a spring 15 contacts the lowermost plate 106*a* or 108*a*. There is also a proximity switch (not shown) associated with each of these trigger assemblies such that upon contact of the end of a spring 15 with the lower plates 106*a*, 108*a* of the assembly, the switch is actuated to initiate reciprocable movement of the forming drums as explained more fully hereinafter.

Figure 2:
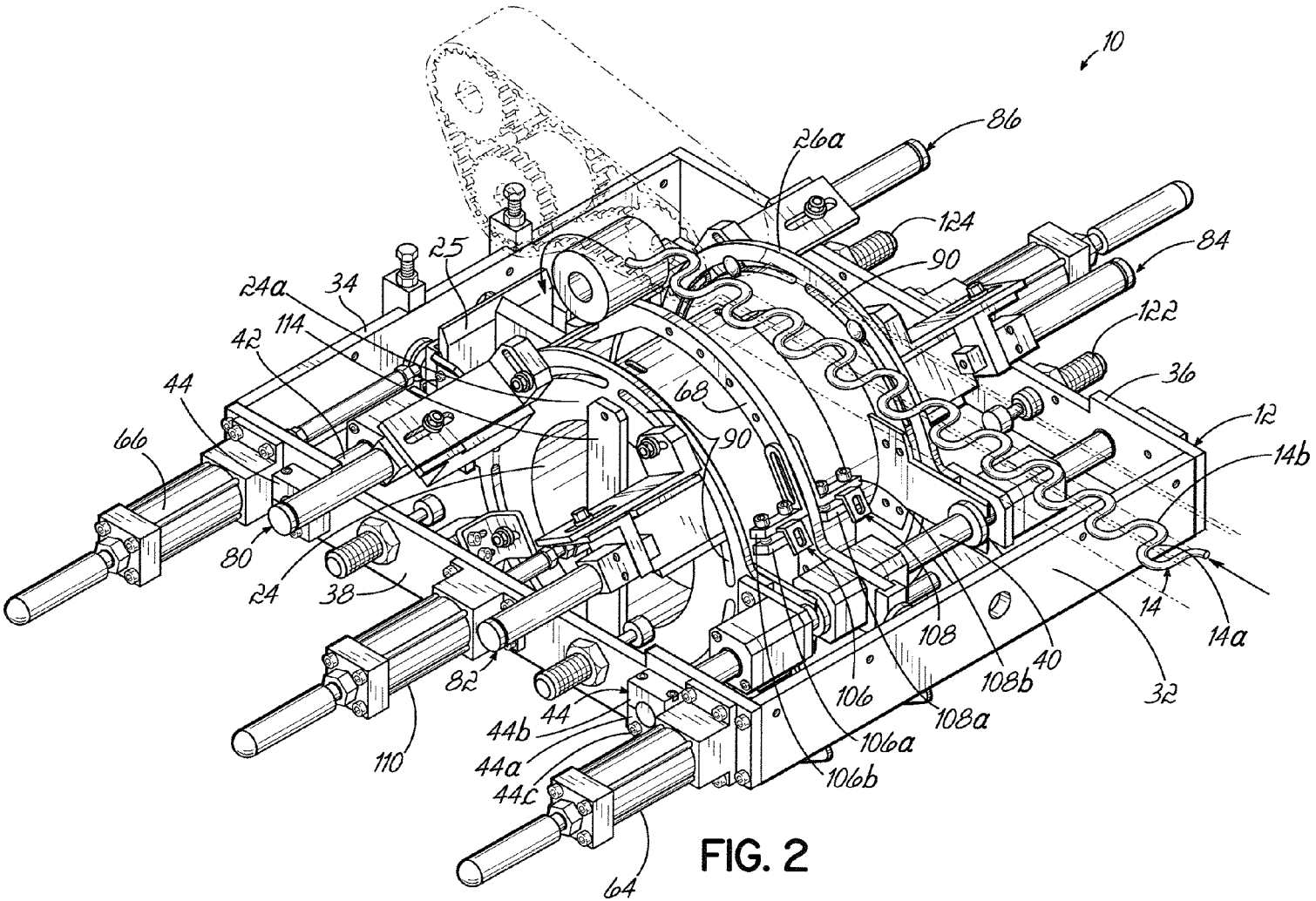
FIG. 2 is an enlarged perspective view similar to FIG. 1, but with a portion of the machine broken away and shown in phantom for clarity purposes.

Fixedly mounted on the outside of each stacking drum 24, 26, there is a side mounting plate 24*a*, 26*a*. These side mounting plates 24*a*, 26*a* serve as mounting plates for skip paddle assemblies 80, 82, 84 and 86 (FIG. 2). Two of these skip paddle assemblies 80, 82 are mounted upon the outside of side mounting plate 24*a*, and two others, 84, 86, are mounted on the outside of the side mounting plate 26*a*.

Each side mounting plate 24*a*, 26*a* has arcuate slots 90 formed therein These arcuate slots are of slightly smaller radius than the radii on the inside of the forming drums 20, 22 and are generally aligned with the inside surface of those forming drums 20, 22. Arcuate shaped skip paddles 96 of the paddle assemblies 80, 82, 84 and 86 are extendable through these slots 90 and engageable with the ends of the springs 15 as those springs are stripped from the forming drums, as explained more fully hereinafter.

The skip paddle assemblies 80, 82, 84 86 are all identical in both configuration and function. Accordingly, only one skip paddle assembly 84 will be described in detail, it being understood that the other skip paddle assemblies 80, 82 and 86 mounted upon their respective side mounting plates are identical.

Figure 7A:
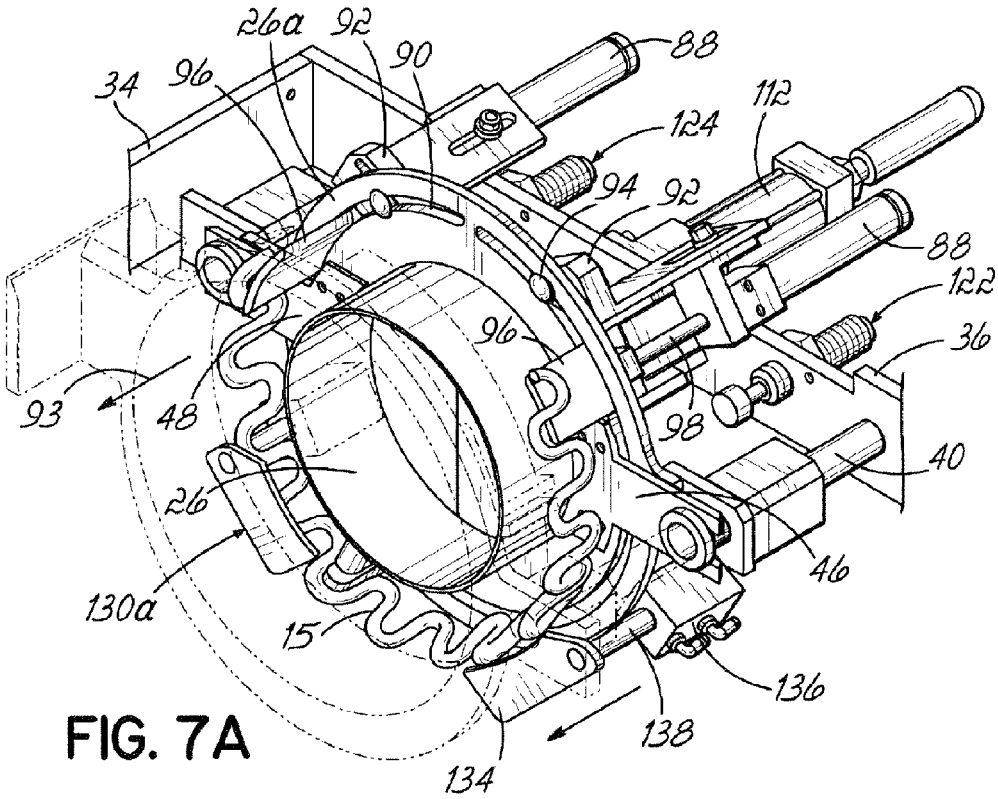
FIG. 7A is a perspective view similar to FIG. 6A but illustrating the positions of the spring and spring clamp assembly after leftward movement of the forming drum, illustrated in phantom, preparatory to the spring dropping inwardly over the rightwardmost stacking drum.
Figure 7B:
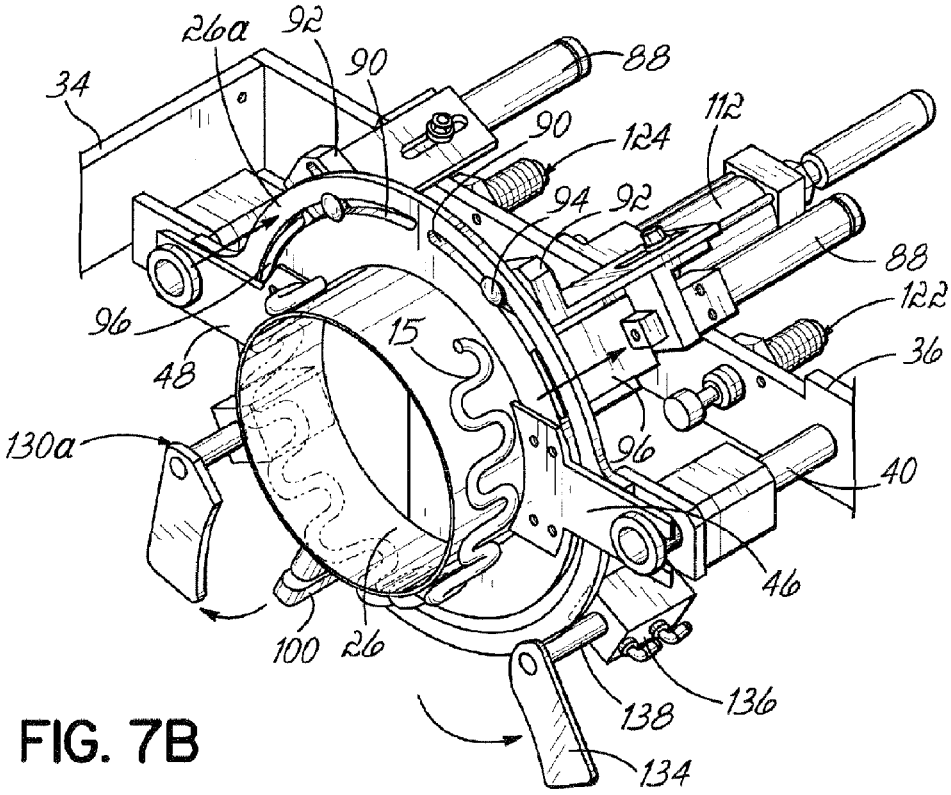
FIG. 7B is a perspective view similar to FIG. 7A but illustrating the position of the spring and spring clamp assembly after leftward movement of the forming drum (not shown) and placement of the spring onto the rightwardmost stacking drum.

With reference to FIGS. 7A and 7B, it will be seen that each skip paddle assembly comprises a pneumatic cylinder 88 secured by a generally L-shaped cylinder mounting block 92 to a side mounting plate. In the case of the skip plate assembly 84, the cylinder mounting plate 90 is adjustably mounted upon the side mounting plate 26*a* and is secured thereto by a bolt 94 which extends through the arcuate slot 90. A paddle 96 is mounted on the inner end of the piston rod 98 associated with each cylinder 88 of each skip paddle assembly. These paddles are arcuately shaped so as to be extendable through the arcuate slots 90 and engageable with the ends of the arcuately configured springs as those springs are moved off of the larger diameter forming drums 20,22. Those paddles engage the ends of the springs and temporarily hold them as the springs move off of the forming drums 20, 22, after which the paddles retract into the arcuate slots 90 so as to permit the ends of the springs to follow the center portions of the springs inwardly into contact with the outside peripheral surface of the stacking drum or the outside peripheral surface of the spring which preceded that formed spring onto the stacking drum.

Figure 8A:
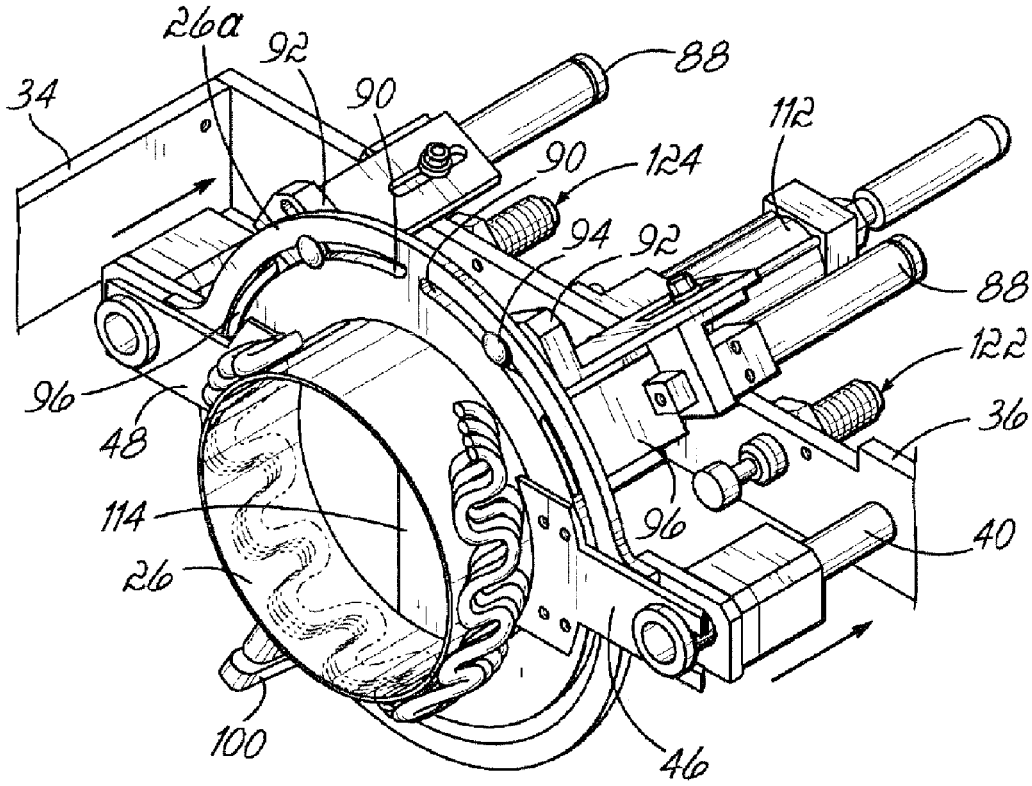
FIG. 8A is a perspective view similar to FIG. 7B but illustrating the stacking drum and stacking drum striping mechanism after placement of a stack of nested springs over the stacking drum.
Figure 8B:
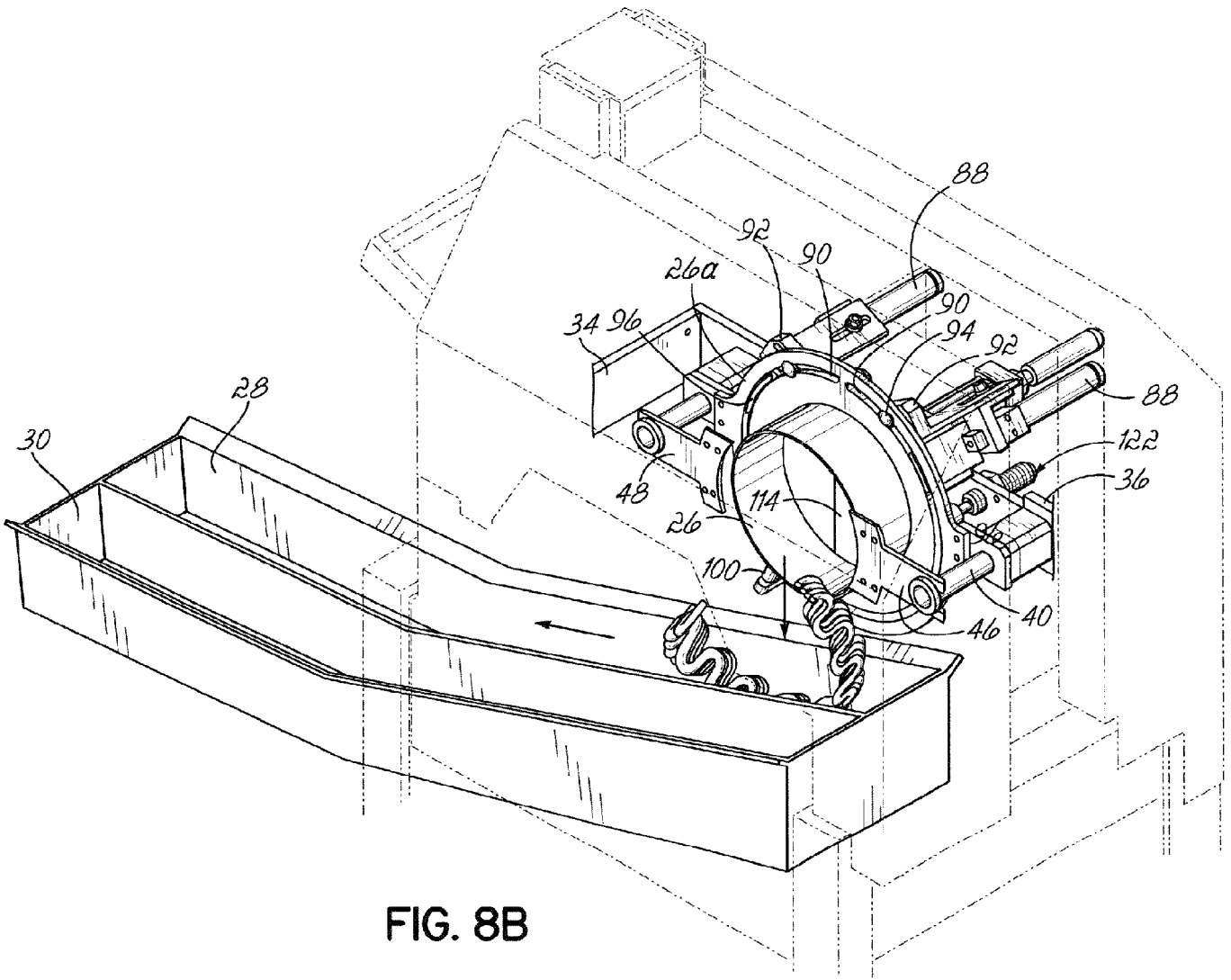
FIG. 8B is a perspective view similar to FIG. 8A after activation of the rightwardmost stacking drum striper mechanism and a stack or coil of nested stacked springs have been stripped from the rightwardmost stacking drum and dropped into a discharge chute located beneath the stacking drum.

Also with reference to FIGS. 7A and 7B, it will be seen that also bolted to each of the side mounting plates 24*a*, 26*a*, there is a spring location finger 100 which extends radially outwardly from the outside peripheral surface of each stacking drum 24, 26. This finger 100 has an inwardly extending slot 102 formed therein so as to enable a forming drum 20 or 22 to slide into and out of this slot 102, as explained more fully hereinafter. This finger functions to locate and align springs on the stacking drum as the springs are removed off of the forming drum and onto the stacking drum. In the course of movement from a forming drum and onto a stacking drum, a loop of the spring fits over this finger 100. Thereby, a stack of springs are all aligned one with the next above it when a stack of nested springs are removed from the stacking drum, as illustrated in FIGS. 8A and 8B.

Spring Clamp Assembly

Figure 3:
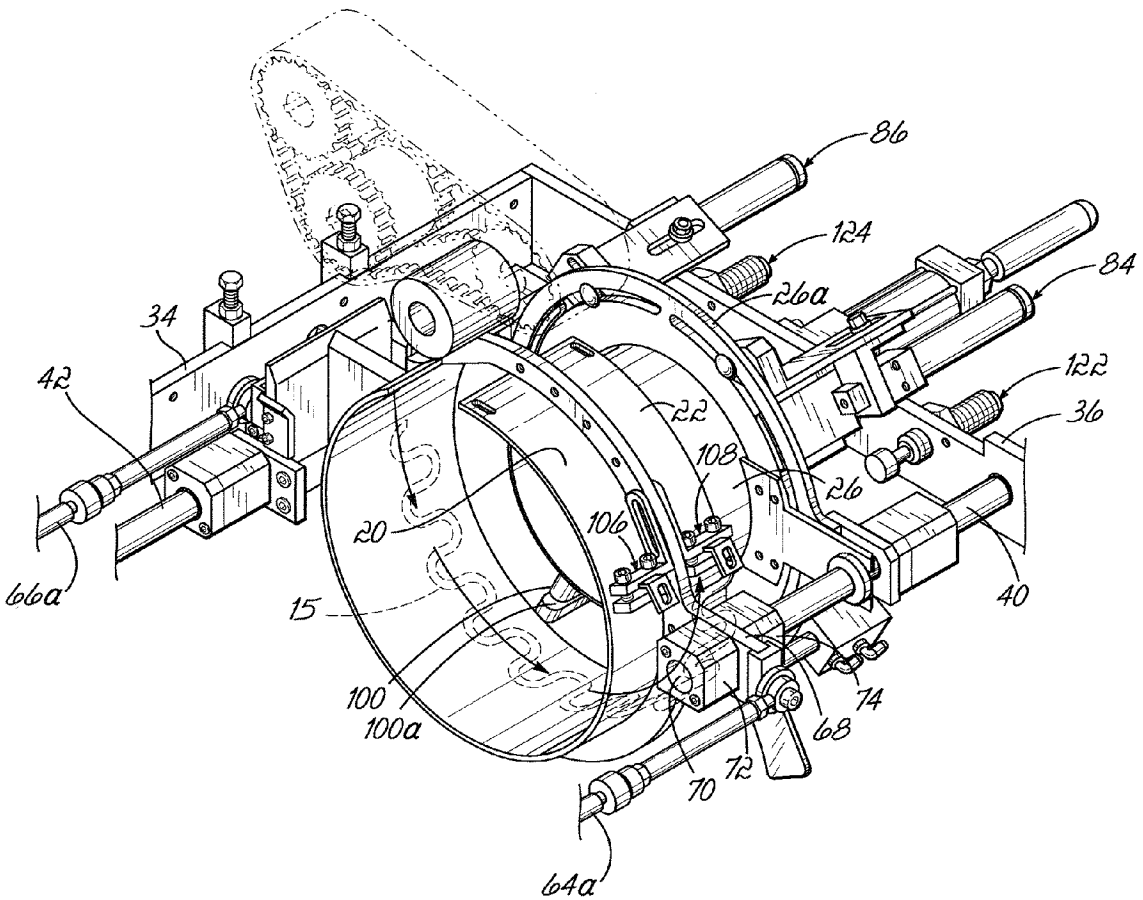
FIG. 3 is a perspective view of a portion of the machine of FIG. 2, but illustrating infeed and placement of a first arcuately formed curvilinear sinuous spring, shown partially in phantom, onto a first forming drum of the machine.
Figure 6A:
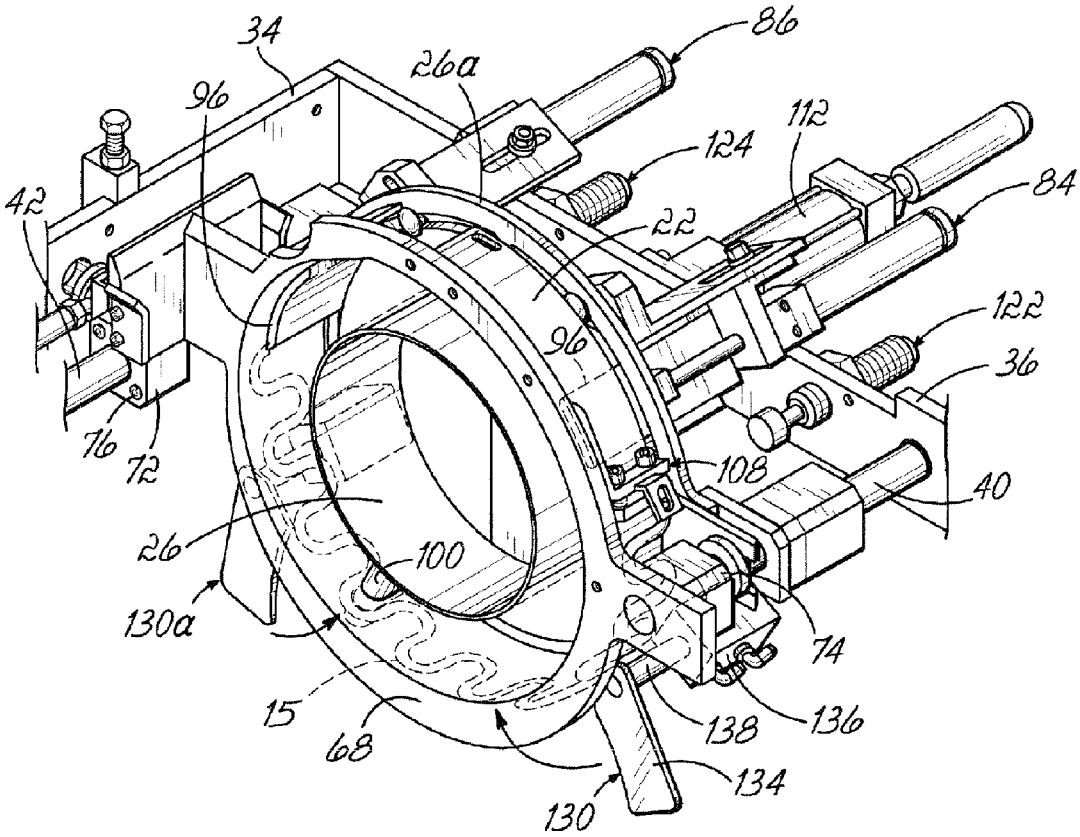
FIG. 6A is a perspective view of the rightwardmost forming drum only and drum stripping mechanism after placement of a spring over the drum preparatory to stripping of the spring from the forming drum.
Figure 6B:
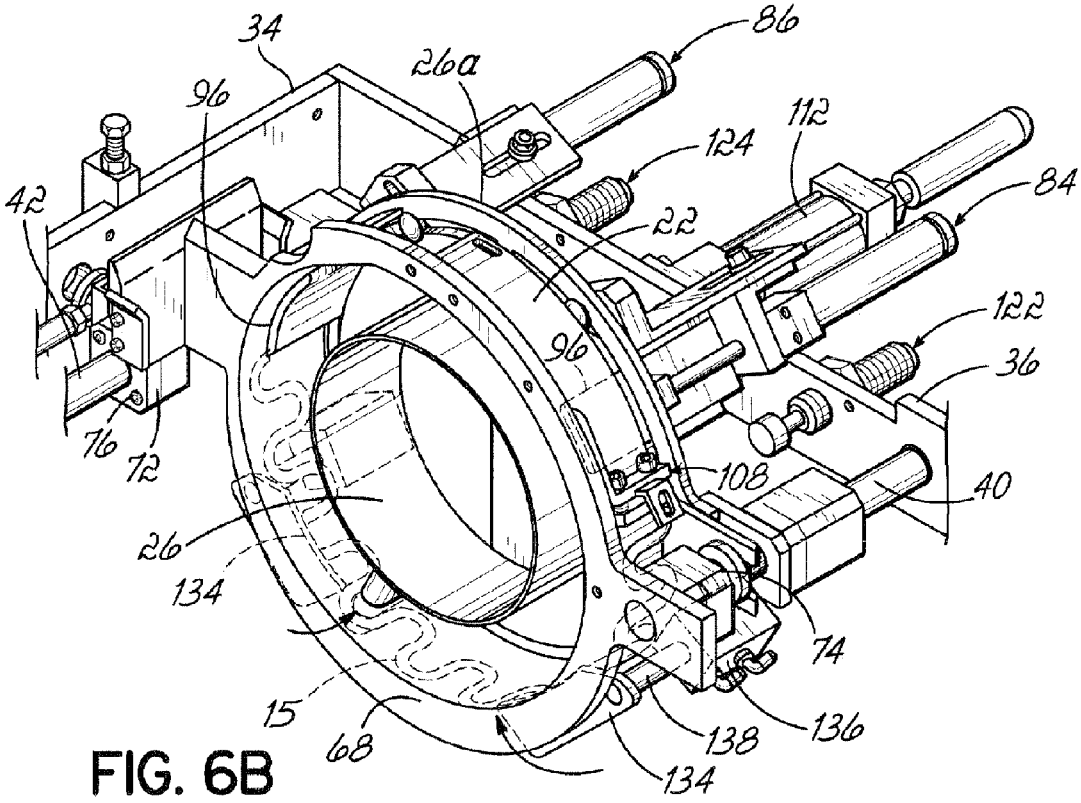
FIG. 6B is a perspective view similar to FIG. 6A but with a spring clamp assembly activated to hold the spring against axial movement of the spring as the forming drum is moved axially in a leftward direction as viewed in FIG. 6B.

Located on the outside of the forming drums, and rotatably movable between a first position illustrated in FIGS. 3, 6A and 7B, and a second position illustrated in FIGS. 6B and 7A, there are two pair of spring clamp assemblies 130, 130*a* and 132, 132*a*. Since each pair of these assemblies are identical and actuated simultaneously, only one (130) of one pair 130, 130*a* will be described in detail, it being understood that the other 130*a*, 132 and 132*a* are identical, but with one of each pair positioned on the opposite side of the forming drum with which it is associated.

Each clamp assembly includes an air cylinder 136 mounted upon a stacking drum mounting plate 24*a* or 26*a* and a pivotal paddle 134 movable between the two positions illustrated in FIGS. 6A and 6B. To pivotally move the paddle between these two positions, the air cylinder 136 is activated to cause a rotatable piston rod 138 of the cylinder 136 to actuate the paddle 134 and move the paddle into contact with the peripheral surface of a forming drum and hold the spring against axial movement as the forming drum is moved axially from under the spring. Thereafter, the air cylinder 136 returns the paddle 134 to the rest position illustrated in FIG. 6A.

Stacking Drum Stripper Mechanism

With reference now to FIG. 1, it will be seen that the stacking drum 24, 26 stripper mechanism comprises a first air cylinder 110 mounted upon the frame side plate 38 on the left side of the machine for affecting reciprocable movement of the stacking drum 24 and a second air cylinder 112 mounted upon the outside of the right side plate 36 operable independently of the air cylinder 110 for affecting reciprocable movement of the stacking drum 26. Each air cylinder 110, 112 has a stacking drum mounting plate 114 mounted on the outer end of the piston rods 110*a*, 112*a* of the respective cylinders 110, 112. The stacking drum 24 is fixedly attached to the mounting plate 114 at the end of the piston rod 110*a* and the stacking drum 26 is fixedly attached to the mounting plate 114 at the end of the piston rod 112*a* associated with the air cylinder 112.

In order to limit reciprocable movement of the stacking drum 24 toward the side plate 38, there are a pair of shock absorbers 118, 120 mounted on the side plate 38 and an identical pair of shock absorbers 122, 124 (see FIG. 3) mounted on the side plate 36. Each of these shock absorbers has a movable piston rod 118*a*, 120*a*, 122*a* and 124*a* spring biased outwardly and positioned so as to be engageable with the rim 24*a* of the drum 24 when the stacking drum 24 is moved toward the side plate 38 and with the rim 26*a* of the drum 26 when the stacking drum 26 is moved outwardly toward the side plate 36.

Operation of the Spring Nesting and Stacking Machine

Figure 9:
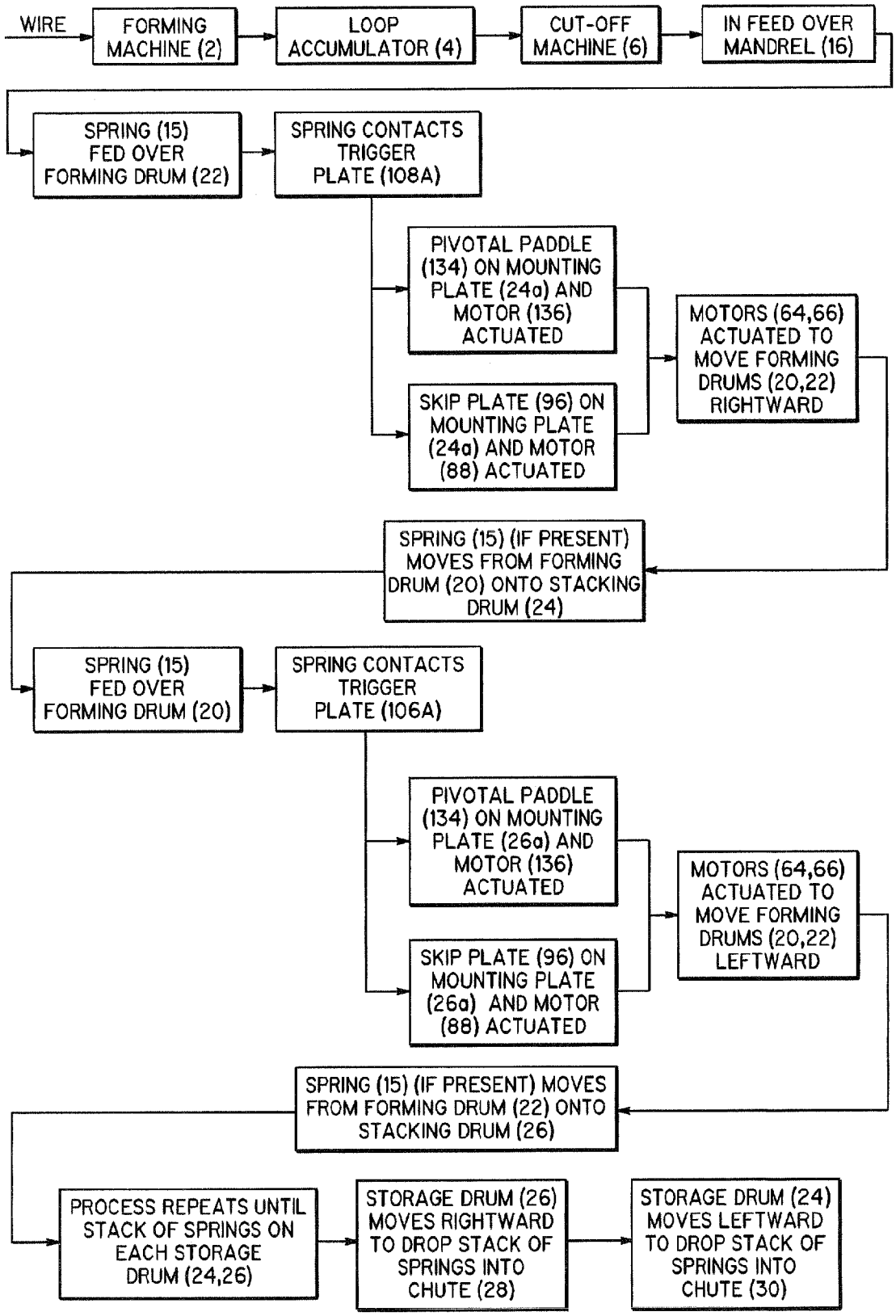
FIG. 9 is a flow chart of the operation of the apparatus and method practiced by the machine of this invention.

Referring first to FIG. 9, operation of the nesting and stacking machine 10 is synchronized and commences with start-up of a parent sinuous spring forming machine 2. That machine is a conventional sinuous wire forming machine operative to form a continuous length of wire into a sinuous pattern of formed wire, such as the sinuous wire illustrated in the drawings of this application. That sinuous wire has multiple parallel bars 14*a*, each bar of which is connected at its opposite ends to adjacent bars via semi-circular end turns 14*b* extending in opposite directions from opposite ends of each bar 14*a*. While the sinuous wire illustrated in the drawings of this application have generally circular end turn sections, that sinuous wire could have end turns of varying configurations, even straight bars. That sinuous wire passes from the forming machine 2 through a conventional loop accumulator 4 to a conventional indexable cut-off machine 6 from whence it is fed via an infeed trackway 8 into the nesting and stacking machine 10. That trackway feeds the incoming straight lengths 14 of sinuous wire into the infeed mechanism 16, the endless belt of which forces that straight wire to pass over the mandrel 18 and thereby have an arcuate configuration imparted to the straight length of sinuous wire. The arc imparted to the then arcuately curved wire is of a radius smaller than the radius of the forming drums 20, 22 and even slightly smaller than the radius of the stacking drums 24, 26. That arcuately formed curvilinear wire then passes between the peripheral surface of a stacking drum 20 or 22 and a stop block 25 stationarily mounted on the rear end of the machine 10 and secured to the rear plate 34 of the machine frame.

With reference to FIG. 2, there is illustrated a straight wire spring 14 being fed into and over the mandrel 18. As there illustrated, that spring, after having an arcuate configuration imparted thereto by the mandrel 18, as the spring passes over the mandrel and beneath the surface of the belt 58, is caused to move onto the peripheral surface of the forming drum 22 and to wrap around that drum until the movement of the spring is blocked by contact with the lower plate 108*a* of the proximity trigger assembly 108. That contact triggers actuation of a proximity switch (not shown) associated with that assembly 108 to initiate cycling of the machine stripper mechanism so as to cause the now arcuately formed curvilinear spring 15 on the forming drum 22 to be moved rightwardly on the forming drum 22 while simultaneously positioning the forming drum 20 in a position beneath the mandrel 18 such that the next following spring will be fed onto the other forming drum 20. This axial movement of the forming drums 20,22 is affected by the simultaneous actuation of the air cylinders 64, 66 which cause the slider plate 68, with its attached forming drums 20, 22, to move rightward, as viewed in FIG. 4. In this rightwardmost position, as viewed in FIG. 4, the stacking drum 26 is located beneath the forming drum 22.

Figure 4:
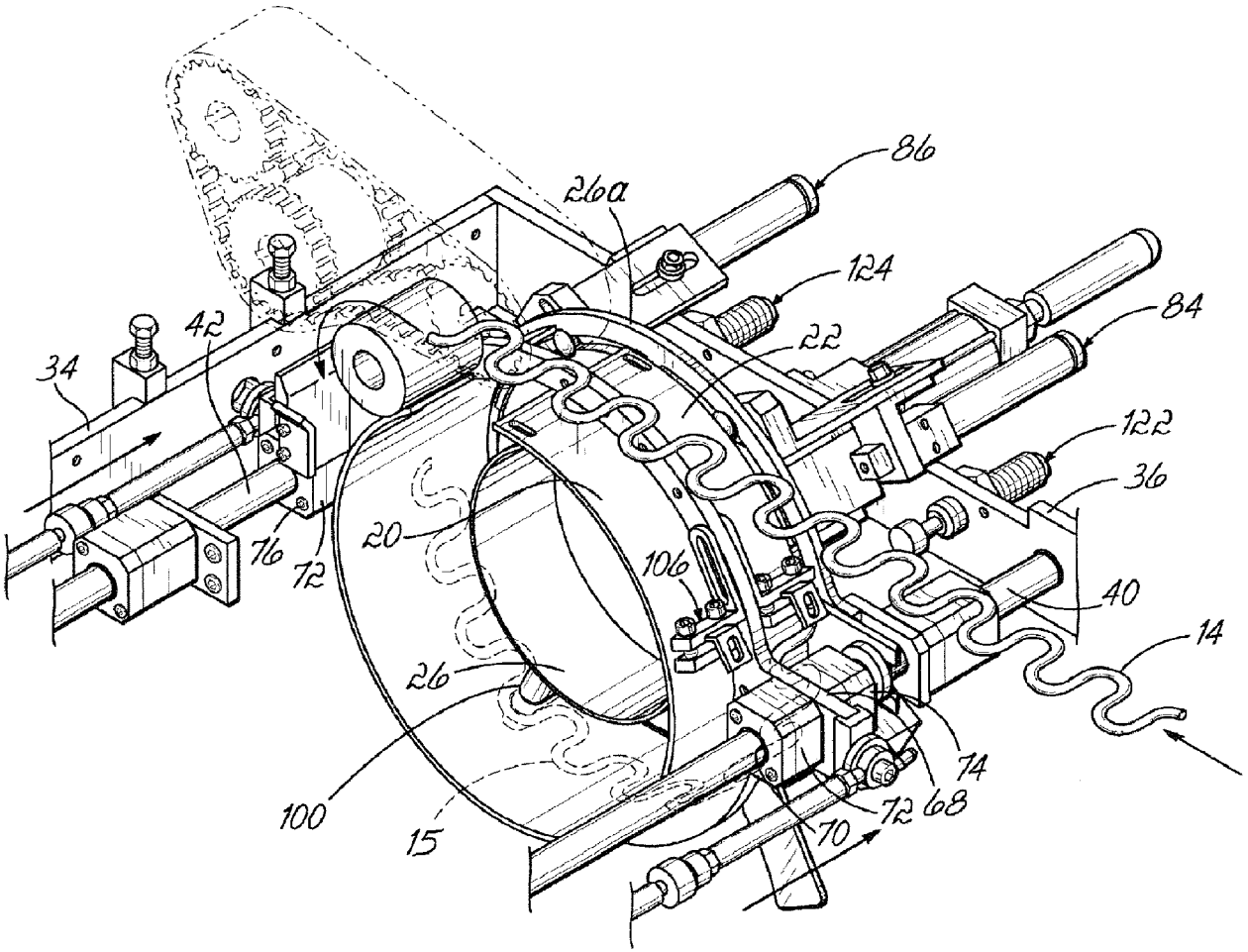
FIG. 4 is a view similar to FIG. 3, but illustrating infeed of a second sinuous spring into the machine preparatory to placement of the second arcuately configured sinuous spring onto the surface of a second forming drum.
Figure 5:
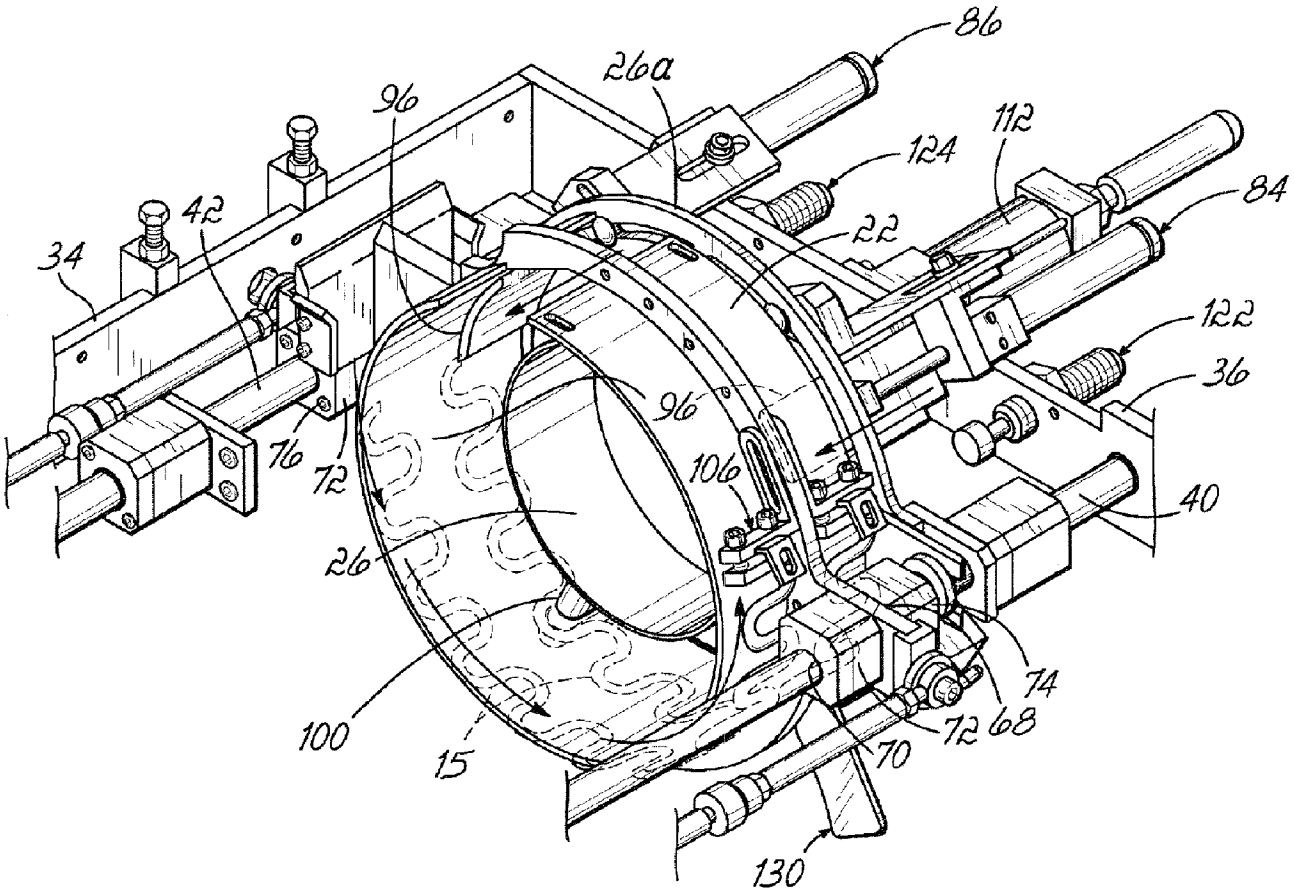
FIG. 5 is a view similar to FIG. 4, but illustrating the infeed of the second arcuately formed curvilinear spring over the second forming drum of the machine.

As viewed in FIGS. 4 and 5, the following straight wire spring 14 is then fed over the mandrel and onto the forming drum 20 and continues to wrap around that forming drum until the leading end of that now arcuately formed configurated spring contacts the lower plate 106*a* of the proximity trigger assembly 106 associated with that forming drum 20. This contact of the end of the spring 15 with the lower plate 106*a* of the proximity trigger assembly 106 actuates the switch associated with that assembly, which, in turn, initiates leftward movement of the slider plate 68 and the forming drums 20, 22 attached thereto.

Before that leftward movement of the slider plate 68 and attached forming drums 20, 22 may be initiated, though, several things need to first happen. The cylinders 136 and the clamping plates 134 associated therewith must be pivoted from the position illustrated in FIG. 6A to the position in FIG. 6B, whereat the inner edge of that plate 134 contacts the peripheral surface of the forming drum 22 near the slider plate 68 so as to hold that spring against axial leftward movement as the slider plate 68 and attached stacking drums 20, 22 move leftwardly. Simultaneously, with the actuation of the clamping plate air cylinders 136, the motors 88 associated with the skip plate assemblies 86 on the rightward side of the frame 12 are actuated so as to cause the skip plates 96 on that side to extend and move inwardly through the arcuate slots 90 in the slider plate 68. When extended, as illustrated in FIG. 7A, these skip plates 96 are located beneath the ends of the spring 15 located on the forming drum 22. As the forming drum 22 moves leftwardly, as indicated by the arrow 93 in FIG. 7A, the spring is held against axial movement with the forming drum by the clamp plates 134 and the ends of the spring are then temporarily held against movement into contact with the underlying stacking drum until after the forming drum 22 has moved completely out from under the spring 15 previously located on that drum. The skip plates 96 then are pulled inwardly to the position illustrated in FIG. 7B, and the ends of the springs allowed to drop onto the stacking drum 26. This temporary holding of the ends of the spring 15 by the skip plates 96 prevents the ends of the springs from becoming entangled with underlying springs on the stacking drums during the stacking of the springs on the stacking drums.

This sequence of operation and the reciprocable movement of the forming drums is then repeated when the slider plate 68 and attached stacking drums are next moved rightward after placement of a spring over the forming drum 20 and contact of a spring on the drum with the proximity trigger assembly 108. The rightward movement of the drums then causes sequential actuation of the clamping plate air cylinder 136 mounted on the mounting plate 24*a* and simultaneously, the actuation of the air cylinder 88 on the plate 24*a* to move the clamping plates 134 and skip plates 96 into positions to prevent rightward movement of the spring 15 on the forming drum 22 and to temporarily hold the ends of the spring 15 as it moves off of the forming drum 22 against inward movement onto the stacking drum 24. Only after the center portion of the spring has moved inwardly over the stacking drums do the skip plate paddles 96 move inwardly and allow the ends of the spring to drop into contact with the stacking drum 24 or, if a spring has been previously been placed upon that drum, into contact with the spring previously placed on that stacking drum.

This leftward and then rightward movement of the forming drums 20, 22 is repeated until an appropriate number of springs have been nested and stacked on each of the stacking drums 24, 26.

After an appropriate number of springs have been nested and stacked on each of the stacking drums 24, 26, as counted by a counter of the controller (not shown) the cylinder 112 associated with the stacking drum 26 is actuated such that its piston rod and attached mounting plate 114 are caused to move rightwardly and in the course of movement, pull the stack of springs 15 nested thereon off of the stacking drum 26 and allow the nested stack of generally circular configurated springs to fall into the discharge chute 28. In the course of movement rightward, as viewed in FIG. 7B, the stripper paddles 46, which are stationarily mounted on the supporting shafts 40, 42, prevent the springs from moving rightward with the stacking drum 26 and force the springs to move off of that stacking drum.

The movements depicted in FIG. 9 and sequential actuation of air cylinder motors of the machine are all cycled by a conventional controller, which has not been illustrated herein, but which may be readily supplied by a person skilled in this art.

While I have described only one preferred embodiment of this invention, persons skilled in this art will appreciate changes and modifications which may be made without departing from the spirit of this invention.

I claim:

1. A method of creating a stack of nested sinuous springs, which method comprises:

forming a continuous length of sinuous spring wire having parallel bar segments interconnected at their opposite ends by oppositely directed connecting segments;

cutting said continuous strip of sinuous wire into strips of discrete lengths;

sequentially passing each of said strips over a forming mandrel to impart an arcuate configuration to said strip;

sequentially moving said arcuate configured strips over a generally circular forming drum;

stripping a first one of said arcuate configured strips from over said forming drum and onto a top surface of a stacking drum;

sequentially stripping a plurality of arcuate configured strips from the forming drum onto the stacking drum and over the top of the strip which preceded it onto said stacking drum to create a nested plurality of arcuate configured springs located on said stacking drum.

2. The method of claim 1 which further comprises:

stripping the nested plurality of arcuate configured springs from said stacking drum and onto a discharge chute.

3. A method of simultaneously creating a pair of stacks of nested sinuous springs, each spring of which comprises a discrete strip of sinuous spring wire having parallel bar segments interconnected at their opposite ends by oppositely directed connecting segments, which method comprises:

sequentially passing each of said strips over a forming mandrel to impart an arcuate configuration to said strip;

sequentially and alternately moving said arcuate configured strips over first and second generally circular forming drums;

stripping a first one of said arcuate configured strips from over a first one of said forming drums and onto a top surface of a first stacking drum and stripping a second following one of said arcuate configured strips from over said second forming drum onto a top surface of a second stacking drum;

sequentially and alternately stripping a plurality of arcuate configured strips from the forming drums onto the first and second stacking drums and over the top of the preceding strips on said stacking drums to create a pair of nested plurality of arcuate configured springs located on said first and second stacking drums.

4. The method of claim 3 which further comprises:

stripping the pair of nested plurality of arcuate configured springs from said first and second stacking drums onto a pair of first and second discharge chutes.

5. Apparatus for creating a stack of nested sinuous wire springs, each spring of which comprises a discrete strip of sinuous spring wire having parallel bar segments interconnected at their opposite ends by oppositely directed connecting segments, which apparatus comprises:

a feeder mechanism for sequentially feeding each of said strips over a forming mandrel to impart an arcuate configuration to each strip and onto the surface of a generally circular forming drum;

a stripper mechanism for stripping a first one of said arcuate configured strips from over said forming drum and onto a top surface of a stacking drum and for sequentially stripping a following plurality of arcuate configured strips from the forming drum onto the stacking drum and over the top of the strip which preceded it onto said stacking drum to create a nested plurality of arcuate configured springs located on said stacking drum; and a second stripper mechanism for stripping the nested plurality of arcuate configured springs from said stacking drum onto a discharge chute.

6. The apparatus of claim 5 wherein said mandrel is rotatable and shaped as a cylinder.

7. The apparatus of claim 6 wherein said feeder mechanism comprises an endless feeder belt.

8. The apparatus of claim 7 wherein said feeder mechanism comprises a driven pulley and a pair of idler pulleys over which said endless belt is movable, said endless belt having one section which conforms to and is movable over an arcuate section of said cylindrical shaped mandrel so as to impart an arcuate configuration to each strip as said strip moves between an exterior surface of said belt and an exterior surface of said mandrel.

9. Apparatus for simultaneously creating a pair of stacks of nested sinuous springs, each spring of which comprises a discrete strip of sinuous spring wire having parallel bar segments interconnected at their opposite ends by oppositely directed connecting segments, which apparatus comprises:

a feeder mechanism for sequentially passing each of said strips over a forming mandrel to impart an arcuate configuration to each of said strips and for sequentially and alternately moving said arcuate configured strips over first and second generally circular forming drums;

a first stripper mechanism for stripping a first one of said arcuate configured strips from over a first one of said forming drums and onto a top surface of a first stacking drum and for stripping a second following one of said arcuate configured strips from over said second forming drum onto a top surface of a second stacking drum, said first stripper mechanism being operable to sequentially and alternately strip a following plurality of arcuate configured strips from the forming drums onto the first and second stacking drums and over the top of the preceding strips on said stacking drums to create a pair of nested plurality of arcuate configured springs located on said first and second stacking drums.

10. The apparatus of claim 9 which further comprises:

a second stripper mechanism for stripping the pair of nested plurality of arcuate configured springs from said first and second stacking drums onto a pair of first and second discharge chutes.

11. The apparatus of claim 9 wherein said mandrel is rotatable and shaped as a cylinder.

12. The apparatus of claim 9 wherein said feeder mechanism comprises an endless feeder belt.

13. The apparatus of claim 12 wherein said feeder mechanism comprises a driven pulley and a pair of idler pulleys over which said endless belt is movable, said endless belt having one section which conforms to and is movable over an arcuate section of said cylindrical shaped mandrel so as to impart an arcuate configuration to each strip as said strip moves between an exterior surface of said belt and an exterior surface of said mandrel.

14. Apparatus for simultaneously creating a pair of stacks of nested sinuous springs, each spring of which comprises a discrete strip of sinuous spring wire having parallel bar segments interconnected at their opposite ends by oppositely directed connecting segments, which apparatus comprises:

a feeder mechanism for sequentially passing each of said strips over a forming mandrel to impart an arcuate configuration to said strip and for sequentially and alternately moving said arcuate configured strips over first and second generally circular forming drums;

a first stripper mechanism for reciprocating said forming drums in an axial direction so as to strip a first one of said arcuate configured strips from over a first one of said forming drums and onto a top surface of a first stacking drum as said first stripper mechanism moves said forming drums in a first direction and for stripping a second following one of said arcuate configured strips from over said second forming drum onto a top surface of a second stacking drum as said mechanism moves said stacking drums in an opposite second direction, said first stripper mechanism being operable to sequentially and alternately strip a following plurality of arcuate configured strips from the forming drums onto the first and second stacking drums and over the top of the preceding strips on said stacking drums as said forming drums are caused to reciprocate by said first stripper mechanism to create a pair of nested plurality of arcuate configured springs located on said first and second stacking drums.

15. The apparatus of claim 14 which further comprises:

a second stripper mechanism for stripping the pair of nested plurality of arcuate configured springs from said first and second stacking drums onto a pair of first and second discharge chutes.

16. The apparatus of claim 15 wherein the second stripper mechanism is operable to reciprocate the stacking drums in an axial direction so as to strip a first of a pair of nested arcuate configured springs from said first stacking drum as said second stripper mechanism moves said first stacking drum in a first direction and to move a second of the pair of nested arcuate configured springs from said second stacking drum as said second stripper mechanism moves said second stacking drum in a second opposite direction.

* * * * *